United States Patent [19]

Diehl

[11] 3,958,059

[45] May 18, 1976

[54] FABRIC TREATMENT COMPOSITION

[75] Inventor: Francis L. Diehl, Wyoming, Ohio

[73] Assignee: The Procter & Gamble Company, Cincinnati, Ohio

[22] Filed: Oct. 1, 1973

[21] Appl. No.: 402,505

[52] U.S. Cl. ..... 428/260; 252/8.8; 252/153; 252/155; 252/528; 252/547; 252/548; 252/DIG. 14

[51] Int. Cl.[2] ..... D06M 13/52; D06M 13/46

[58] Field of Search ..... 252/8.8, 8.6, 547, 155; 117/139.5 F, 139.5 CQ, 139.5 CF; 260/DIG. 16, DIG. 20; 428/260

[56] References Cited

UNITED STATES PATENTS

| | | | |
|---|---|---|---|
| 2,775,617 | 12/1956 | Shapiro et al. | 260/567.6 M |
| 2,999,774 | 9/1961 | Schappel | 117/139.5 CF |
| 3,117,113 | 1/1964 | Tudor | 252/8.75 |
| 3,274,106 | 9/1966 | Smiens | 252/8.8 |
| 3,515,580 | 6/1970 | Eastes | 252/8.6 |
| 3,537,993 | 11/1970 | Coward et al. | 252/8.8 |
| 3,594,212 | 7/1971 | Ditsch | 117/139.5 CF |
| 3,646,219 | 2/1972 | Peterson | 252/8.6 |
| 3,686,025 | 8/1972 | Morton | 252/8.8 |
| 3,850,818 | 11/1974 | Katsumi et al. | 252/8.8 |
| 3,862,058 | 1/1975 | Nirschl et al. | 252/8.6 |

*Primary Examiner*—Murray Tillman
*Assistant Examiner*—W. C. Danison, Jr.
*Attorney, Agent, or Firm*—Charles R. Wilson; Jerry J. Yetter; Julius P. Filcik

[57] ABSTRACT

Improved anti-static and fabric softening compositions are prepared by dispersing electrically conductive metal salts in quaternary compounds. Stable, liquid dispersions of the quaternary-metal salt compositions are obtained in the presence of amide dispersion stabilizers.

18 Claims, No Drawings

FABRIC TREATMENT COMPOSITION

BACKGROUND OF THE INVENTION

The present invention relates to improved anti-static and fabric softening materials, and stabilized compositions containing same. More particularly, the invention encompasses conductive salts dispersed in a substantially water-insoluble quaternary ammonium or quaternary phosphonium compound. Improved liquid fabric softening and anti-static compositions stabilized with amides are also provided.

It has long been recognized that surface active agents, especially cationic materials such as the quaternary ammonium compounds, provide an advantageous softening and anti-static effect when applied to fabrics. Moreover, it has been suggested that various conductive salts should provide an anti-static benefit when applied to fabrics. However, it has been concluded that conductors such as the inorganic salts are not suitable for general use as anti-static agents on textiles, inasmuch as they are corrosive, abrasive, non-adhering or easily removed by water. In theory, however, electrically conductive salts should provide a mechanism whereby static electrical charges can be dissipated from fiber and fabric surfaces; see, for example, *American Dyestuff Reporter*, P405, June 21, 1954.

While the quaternary ammonium compounds commercially employed as softening agents are effective for this intended use, the anti-static properties of such materials are not optimum. This may be due to the highly localized attachment of the quaternary compounds to fabric surfaces which counteracts the inherent ability of these compounds to dissipate static electricity. Moreover, it is recognized that by raising the water concentration at a fiber/air interface, electrical charges can be more rapidly dissipated. When affixed to a fabric surface, the quaternary compounds do not provide the requisite charge mobility and/or hygroscopicity necessary for optimal anti-static performance.

A number of methods for providing improved fabric softening and anti-static compositions have been suggested. For example, U.S. Pat. No. 3,329,609 teaches the use of fluosilicic acid salts in combination with quaternary ammonium compounds. The efficacy of such compositions is taught to be caused by the polyvalent anionic character of the fluosilicic acid anion. While presumably effective for their intended use, the fluosilicate salts are derivatives of fluosilicic acid, which is toxic, corrosive, and extremely difficult to work with on a commercial scale.

U.S. Pat. No. 3,154,489 discloses the use of various polyvalent anionic materials in combination with quaternary ammonium compounds as fabric softeners.

The co-pending application of Morton, Ser. No. 335,194, filed Feb. 23, 1973, relates to the use of organic fatty acid derivatives in combination with various quaternary compounds as detergent-compatible fabric softening compositions. However, the Morton compositions do not contain metal salts dispersed throughout the insoluble phase comprising the quaternary compound in the manner disclosed hereinafter.

U.S. Pat. No. 3,719,613 discloses detergent compositions comprising metal salts of complex cyclic amines said to be useful as anti-static agents. However, the complex amine salts of this patent are not related to the standard quaternary ammonium compounds employed herein.

By the present invention there are provided improved fabric softening and anti-static compositions comprising an electrically conductive metal salt dispersed in a matrix comprising a substantially water-insoluble cationic quaternary compound. Such compositions are useful per se as softening and anti-static agents in the manner disclosed in the concurrently filed application of Montgomery, et al., Ser. No. 402,504, filed Oct. 1, 1973, incorporated herein by reference.

The present compositions can also be formulated as liquid fabric softeners having improved anti-static properties comprising a dispersion of the combined softening and anti-static agents herein in a liquid medium. However, stable liquid dispersions of quaternary compounds are difficult to prepare, and the presence of the electrically conductive salts herein poses additional stability problems when preparing such dispersions; see U.S. Pat. No. 3,591,405. It has now been found that amides can be used as stabilizing agents to provide stable, homogeneous dispersions of the improved softening and anti-static agents herein.

It is an object of the present invention to provide improved anti-static materials comprising an electrically conductive salt dispersed in a quaternary compound.

A second object herein is to provide improved fabric softening and anti-static compositions.

It is still a further object herein to provide improved fabric softening and anti-static compositions as stable, homogeneous liquid dispersions.

These and other objects are obtained herein as will be seen from the following disclosure.

SUMMARY OF THE INVENTION

The present invention encompasses novel, substantially water-insoluble, water-dispersible anti-static and fabric softening compositions, comprising:

i. a quaternary compound of the formula

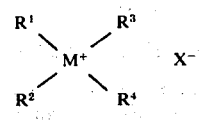

wherein M is nitrogen or phosphorus, X is any anion, $R^1$ is a hydrocarbyl moiety, $R^2$ is hydrogen or a hydrocarbyl moiety, the total carbon content of $R^1 + R^2$ being at least 22 carbon atoms, and $R^3$ and $R^4$ are each hydrogen or hydrocarbyl moieties; and ii. an electrically conductive salt selected from the group consisting of aluminum salts and non-fluosilicate lithium salts dispersed in said quaternary compound, at a weight ratio of quaternary compound: salt in the range of 1000:1 to 1:2.

The invention herein also encompasses stable, liquid fabric softeners having improved anti-static properties. The fabric softeners herein are characterized as an insoluble fabric softener and anti-static component dispersed in a liquid carrier component which does not substantially dissolve said softener/anti-static component, said dispersion being stabilized by an amide stabilizing component. More particularly, such fabric softening compositions having improved anti-static properties comprise:

a. from about 1% to about 45% by weight of a substantially water-insoluble, water-dispersible softener and anti-static component, comprising:

i. a quaternary compound of the formula

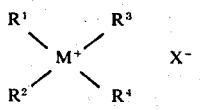

wherein M is nitrogen or phosphorus, X is any anion, $R^1$ is a hydrocarbyl moiety, $R^2$ is hydrogen or a hydrocarbyl moiety, the total carbon content of $R^1 + R^2$ being at least 22 carbon atoms, and $R^3$ and $R^4$ are each hydrogen or hydrocarbyl moieties; and ii. any electrically conductive salt dispersed in said quaternary compound, at a weight ratio of quaternary compound salt in the range of 1000:1 to 1:2, dispersed in:

b. from about 10 to about 95% by weight of a non-solubilizing liquid carrier component; and c. from about 0.1 to about 45% of an amide dispersion stabilizing component, the weight ratio of said amide of said quaternary compound being at least 0.1:1.

Fabrics can be softened and the static electrical charges on the fabric surfaces dissipated by contacting said fabrics with the present compositions. This is conveniently achieved by adding from about 0.01 to about 0.5% by weight of the compositions herein to an aqueous rinse bath containing the fabrics being treated.

DETAILED DESCRIPTION OF THE INVENTION

The compositions herein comprise a quaternary compound and a conductive salt as a softening and anti-static component. When formulated as liquids, the compositions herein additionally contain a liquid carrier component and an amide stabilizing component. These various ingredients are described, in turn, below.

Quaternary Compound

The quaternary compounds employed herein are substantially water-insoluble ammonium and phosphonium materials well-known in the art. Both the ammonium and phosphonium compounds herein can be prepared from alkyl halides and amines or phosphines in the manner described in U.S. Pat. No. 2,775,617. The ammonium compounds are preferred for use herein by virtue of their availability and relatively low cost.

More particularly, the ammonium and phosphonium salts employed in the present compositions are substantially water-insoluble materials. By "substantially water-insoluble" is meant that the compounds employed herein are not substantially dissolved in water at a temperature below about 130°F. The water-insolubility of the quaternary compounds herein is the result of the hydrophobic characteristics of the hydrocarbyl substituents in the compounds. For purposes of the present invention, the requisite water-insolubility is realized when the total carbon content of groups $R^1$ and $R^2$ is at least 22 carbon atoms. For most purposes, di-long chain compounds wherein groups $R^1$ and $R^2$ are each $C_{11}$–$C_{18}$ hydrocarbyl moieties, and mixtures thereof, are preferred for use herein. However, compounds wherein group $R^1$ is $C_{22}$, and greater, and wherein group $R^2$ is a short-chain hydrocarbyl moiety, are sufficiently water-insoluble to be useful herein. $R^3$ and $R^4$ can be $C_1$–$C_{18}$ hydrocarbyl moieties.

Preferred quaternary compounds herein have groups $R^1$, $R^2$, $R^3$ and $R^4$ as hydrocarbyl moieties. The term hydrocarbyl moiety as employed herein encompasses alkyl, alkenyl, aryl, alkaryl, substituted alkyl and alkenyl, and substituted aryl and alkaryl groups. Common substituents found on quaternary compounds include hydroxy and alkoxy groups, and substituted compounds of this type are well-recognized in the art as useful fabric softening materials.

The most preferred quaternary compounds herein are those wherein the substituent groups $R^1$, $R^2$, $R^3$ and $R^4$ are alkyl groups. Especially preferred materials herein are the di-long chain compounds wherein $R^1$ and $R^2$ are each selected from the group consisting of $C_{11}$–$C_{18}$ alkyl moieties, and mixtures thereof, and wherein $R^3$ and $R^4$ are each selected from the group consisting of short-chain $C_1$–$C_3$ alkyl moieties, and mixtures thereof.

While it is possible to prepare the quaternary compounds employed herein using pure alkyl amines or alkyl phosphines or pure alkyl halides, for economic reasons raw materials with mixed hydrocarbyl moieties are commonly employed. The use of such mixtures results in the formation of mixtures of the quaternary compounds, and all such mixtures are contemplated for use herein. A particularly advantageous quaternary mixture herein is a derivative of tallow chain length hydrocarbons, di-tallowalkyl dimethyl ammonium chloride.

In the quaternary compounds herein, the anion, X, provides electrical neutrality. The nature of anion, X, is of no consequence to the present invention and any anion is useful herein. Most often, the anion used to provide electrical neutrality in quaternary compounds is a halide, such as fluoride, chloride, bromide, or iodide. However, particularly useful anions in fabric-softening quaternary compounds also encompass methylsulfate, ethylsulfate, hydroxide, acetate, sulfate, carbonate, and the like. Chloride is especially preferred herein as anion, X, inasmuch as the alkyl chlorides are economically attractive precursors for preparing quaternary compounds.

The following are non-limiting examples of the water-insoluble, water-dispersible quaternary compounds which can be employed herein: docosyl ammonium chloride; docosyl ethyl ammonium bromide; docosyl dimethyl phosphonium fluoride; docosyl tributyl phosphonium hydroxide; di-octadecyl dimethyl phosphonium hydroxide, tetrakis-dodecyl ammonium methylsulfate; tallowalkyl pentyl dimethyl ammonium chloride; di-tallowalkyl dimethyl ammonium chloride; di-tallowalkyl dimethyl ammonium methyl sulfate; di-hexadecyl dimethyl ammonium chloride; di-octadecyl dimethyl ammonium chloride; di-eicosyl dimethyl ammonium chloride; di-docosyl dimethyl ammonium chloride; di-hexadecyl diethyl ammonium chloride; di-hexadecyl dimethyl ammonium acetate; di-tallowalkyl dipropyl ammonium phosphate; di-tallowalkyl dimethyl ammonium nitrite; and di-(coconutalkyl) dimethyl ammonium chloride.

Conductive Salt

The conductive salts employed in combination with the quaternary compounds herein can be any salt which can dissociate into its component cation and anion, thereby providing a means for conducting electrical charges. Preferred salts herein are those having a cation-anion bond of at least 50% ionic character, as calculated in the manner described in Pauling, "The Nature of the Chemical Bond", 3rd Ed. (1960). The most preferred salts herein are those wherein the cation has a small radius and/or multiple charges. A small ionic radius provides rapid ionic mobility, thereby promoting dissipation of static charges at a rapid rate. Highly charged cations are more efficient in dissipating electrical charges than are monovalent cations. While any metal salt is useful herein, it is preferred to select salts of cations which are relatively non-toxic and are not highly colored, so as to prevent undesirable side-effects when the salts are absorbed on a fabric surface.

The salts useful herein are prepared by neutralizing the base form of the selected metal cation with an acid. Of course, the anion of the acid then becomes the anion of the resulting salt. Essentially any acid can be used herein to prepare the conductive metal salts used in the present compositions. Inorganic acids, such as HCl, HBr, HI, $H_2SO_4$, $HNO_3$, $H_3PO_4$, and the like, can be employed. Organic acids such as acetic acid, propionic acid, butyric acid, and the $C_{10}$–$C_{18}$ fatty acids are all useful herein. The inorganic acid salts are preferred herein from the standpoint of cost and availability. Moreover, the inorganic salts are more readily dispersed in the quaternary ammonium compounds herein.

Representative examples of conductive metal salts useful herein are as follows: LiCl; NaCl, CsBr; $MgCl_2$; $CaCl_2$; $Zn(NO_3)_2$; $Al_2(SO_4)_3$; $InCl_3$; $Ti(SO_4)_4$; and the like. Organic salts useful herein include, for example, sodium acetate, magnesium propionate, aluminum acetate, aluminum acetate, aluminum laurate; aluminum dodecylbenzene sulfonate and the like.

Especially preferred salts herein are hydrated, inasmuch as the waters of hydration aid in the dissipation of static electrical charges. Examples of hydrated salts useful herein include $CaCl_2.6\ H_2O$; $LiCl.1\ H_2O$; $MgCl_2.6\ H_2O$; and $Al_2(SO_4)_3.18\ H_2O$.

The salts of aluminum and lithium are especially preferred herein. Lithium provides a small, highly mobile cation which is particularly effective in dissipating static electrical charges when employed in the present manner. Aluminum provides a highly charged, highly mobile cation which is especially effective in dissipating static electrical charges both by virtue of its ionic mobility and its poly-cationic character. Moreover, aluminum salts are inexpensive and non-staining and are most preferred herein.

Preferred metal salts useful herein include $Al_2(SO_4)_3$; $Al_2(SO_4).18\ H_2O$; $LiCl.1\ H_2O$; $MgCl_2.6\ H_2O$; $CaCl_2.6\ H_2O$; NaCl; and KCl. $Al_2(SO_4)_3$, $LiCl.1\ H_2O$ and $Al_2(SO_4)_3.18\ H_2O$ are especially preferred for use in the present compositions and processes, with $Al_2(SO_4)_3.18\ H_2O$ being most preferred.

Processing

The compositions herein comprise the conductive salt dispersed in and with the quaternary compound. It is desirable that the dispersion of the salt be uniform throughout the matrix comprising the quaternary compound. Moreover, it is desirable to provide the compositions in the form of finely divided particles. For these reasons, high shear mixing is preferably used to prepare the instant salt/quaternary compositions.

Two procedures can be employed to prepare the instant compositions. In the first, the conductive salt is reduced to a fine state of aggregation by grinding, or the like, to provide a powder. The average particle size distribution of the powdered conductive salts is not critical for the present purposes, but will commonly be within the range of from about 0.01 microns to about 100 microns. The quaternary compound is melted and the powdered conductive salt added thereto. The mixture is blended to provide intimate contact between the quaternary compound and conductive salt. The composition is then further blended in a colloid mill or ribbon blender, thereby establishing the salt as a uniform dispersion within the matrix comprising the quaternary compound.

In a second procedure, the metal salt is dissolved in water, conveniently at a concentration of from about 25 to about 50% by weight, and the aqueous solution is thoroughly admixed with a melt of the quaternary compound. The aqueous salt solution and quaternary compound are blended, preferably with high shear mixing, and the conductive salt preferentially migrates into the mesomorphic phase comprising the quaternary compound. Once the conductive salt is established in the quaternary compound matrix, the excess water is removed by filtration or evaporation.

In the preparation of the compositions herein, it is preferred to employ the quaternary compound in the form of a melt. Most of the water-insoluble quaternary compounds have melting points above about 120°F. Accordingly, it is convenient to admix the quaternary compound with a modicum of water and alcohol, preferably isopropyl alcohol, to lower the melting point of the quaternary material to a range of from about 70° to about 90°F. In such fashion, the quaternary compound is rendered pasty and the dispersion of the salt therein can be conveniently achieved at plant operating temperatures. For most purposes, from about 5 to about 10% by weight of water and/or water-alcohol mixtures will provide the quaternary compound in this convenient pasty form. The water and alcohol can be removed from the final composition by evaporation, or can be simply left in the composition, depending on the desires of the user.

Preferred compositions herein prepare in the foregoing manner comprise the conductive salt dispersed in the quaternary compound at a weight ratio of quaternary compound:conductive salt in the range from about 20:1 to about 1:2. A highly preferred composition herein comprises from about 5 to about 50% by weight of $Al_2(SO_4)_3.18\ H_2O$ and from about 50 to about 95% by weight of di-tallowalkyl dimethyl ammonium chloride.

LIQUID SOFTENER COMPOSITIONS

The foregoing compositions can be employed as liquid dispersions useful as fabric softeners and anti-static agents. In the preparation of such liquid dispersions, it is necessary to employ a liquid carrier component for the fabric softening and anti-static compositions herein, as well as an amide component. The amide provides a stabilizing function so that stable, liquid dispersions of the compositions herein are obtained. In the absence of the amide stabilizer, the compositions herein rapidly separate into a liquid phase and a quaternary compound/salt phase.

The liquid carriers useful herein are those which do not substantially dissolve the quaternary compound- /salt compositions. Of course, the carrier materials should be selected from those which are suitable for use in a laundering operation, i.e., by relatively non-toxic, non-flammable and non-colored. Water is a preferred liquid carrier herein. Water-alcohol mixtures having a water:alcohol weight ratio in the range of from 100:1 to about 2:1 are also useful herein. The alcohols which can be employed in water-alcohol carrier liquid mixtures herein include methanol, ethanol, propanol, iso-propanol, butanol, and the like, as well as diols and poly-ols such as ethylene glycol, propylene glycol, and the like. Ethanol and iso-propanol are preferred herein from the standpoint of cost and freedom from toxicological and odor problems. When alcohols are employed in the liquid carrier, it is necessary that they not be used in such high concentrations that the quaternary compound/salt compositions are substantially solubilized. For most purposes, water-alcohol mixtures containing less than about 10% by weight of alcohol are most preferred as a carrier component.

The amide stabilizing component used in the liquid compositions herein can be any amide. Of course, it is preferred to use long-chain fatty amides commonly used in various detergent compositions, inasmuch as such materials have a long history of use on fabrics. However, any amide will provide the dispersion stabilizing function herein, to a greater or lesser degree.

The amide stabilizers are used herein at a weight ratio of amide:quaternary compound of at least 0.1:1, preferably about 0.2:1 to about 1:1. When the less effective stabilizing amides are employed, the use concentration is simply increased until the desired dispersion stability is achieved.

Preferred amide stabilizers herein are of the formula:

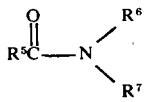

wherein $R^5$ is a $C_{10}$–$C_{20}$ hydrocarbyl moiety, or mixtures thereof, and $R^6$ and $R^7$ are each selected from hydrogen, hydroxyalkyl, alkoxy, or hydrocarbyl moieties, the total carbon content of $R^6 + R^7$ being less than 20 carbon atoms.

Representative examples of amides which can be employed as dispersion stabilizers in the liquid compositions herein include: N,N-dimethyl decanamide; N,N-diethyl dodecanamide; N-propyl tetradecanamide; hexadecanamide; N-hydroxyethyl octadecanamide; N,N-di-methoxy eicosanamide; N-phenyl decanamide; N-tolyl decanamide; and the like.

Alkanol amides, wherein group $R^5$ is an alkyl hydrocarbyl moiety in the $C_{10}$–$C_{20}$ range and wherein groups $R^6$ and $R^7$ are each $C_1$–$C_3$ alkyl or hydroxyalkyl moieties, or hydrogen, are preferred herein. Mixed materials, e.g., those wherein group $R^5$ is mixed coconutalkyl or tallowalkyl, are preferred herein, both from the standpoint of cost and efficacy as dispersion stabilizers. Particularly useful amide stabilizers herein include coconutalkyl ethanol amide and iso-stearyl diethanol amide.

The liquid fabric softening and anti-static compositions herein are prepared by admixing the particulate fabric softening and anti-static component comprising the quaternary compound and conductive salt prepared in the manner disclosed above, the liquid carrier component, and the dispersion stabilizing amide. The mixture components are blended and a stable dispersion forms spontaneously.

Preferred fabric softener compositions having improved anti-static properties comprise:

a. from about 1 to about 45% by weight of the substantially water-insoluble, water-dispersible softening and anti-static component comprising the quaternary compound and electrically conductive salt, as disclosed hereinabove, dispersed in;
b. from about 10 to about 95% by weight of a non-solubilizing liquid carrier component, as disclosed hereinabove; and
c. from about 0.2 to about 45% by weight of an amide dispersion stabilizing component.

Highly preferred compositions herein are those wherein the conductive salt is selected from the group consisting of aluminum salts and lithium salts, with the $Al^{+3}$ salts most preferred.

Liquid compositions which are superior from the standpoint of effectiveness, low cost and ease of formulation comprise:

a. from about 1 to about 15% by weight of the substantially water-insoluble, water-dispersible softener and anti-static component consisting essentially of:
   i. from about 40 to about 99% by weight of di-tallowalkyl dimethyl ammonium chloride; and
   ii. from about 1 to about 60% by weight of a conductive salt selected from the group consisting of $Al_2(SO_4)_3$, $Al_2(SO_4)_3.18\ H_2O$, $LiCl.1\ H_2O$, $MgCl_2.6\ H_2O$, $CaCl_2.6\ H_2O$, NaCl and KCl, dispersed in;
b. from about 70 to about 99% by weight of a liquid carrier component selected from the group consisting of water and water-alcohol mixtures containing less than about 10% weight of alcohol; and
c. from about 0.2 to about 15% by weight of an amide stabilizing component selected from the group consisting of coconutalkyl ethanol amide and iso-stearyl diethanol amide.

Highly preferred compositions herein are those wherein the conductive salt is $Al_2(SO_4)_3.18\ H_2O$ and wherein the amide is coconutalkyl ethanol amide or iso-stearyl diethanol amide.

The following examples illustrate the compositions and processes herein, but are not intended to be limiting thereof.

EXAMPLE I

An anti-static composition in the manner of this invention is as follows:

| Ingredient | Wt.% |
|---|---|
| Di-tallowalkyl dimethyl ammonium chloride | 65 |
| $Al_2(SO_4)_3.18\ H_2O$ | 35 |

The foregoing composition is prepared by blending the di-tallowalkyl dimethyl ammonium chloride at an 80:20 weight ratio with a 1:1 mixture of isopropyl alcohol and water. The resulting pasty mass is melted on a hot water bath and the hydrated aluminum sulfate in the form of a powder (avg. particle diameter 5 microns) is blended therewith. After thorough blending to provide a homogeneous dispersion of the aluminum sulfate salt in the quaternary matrix, the mixture is passed through a colloid mill and subjected to 0.2 atm. vacuum at 70°F for about 30 minutes to remove excess moisture and alcohol. The resulting composition is melted and sprayed onto 1 micron diameter sodium silicate particles to provide a dry, free-flowing particulate anti-static composition.

In the foregoing example, the di-tallowalkyl dimethyl ammonium chloride is replaced by an equivalent amount of di-tallowalkyl dimethyl ammonium bromide, di-tallowalkyl dimethyl ammonium methyl sulfate, di-tallowalkyl dimethyl ammonium ethyl sulfate, di-coconutalkyl dimethyl ammonium chloride, di-coconutualkyl dimethyl ammonium bromide, di-coconutalkyl dimethyl ammonium methyl sulfate, di-coconutalkyl dimethyl ammonium ethyl sulfate, and di-stearyl dimethyl ammonium chloride, respectively, and equivalent anti-static compositions are secured.

In the foregoing example, the hydrated aluminum sulfate is replaced by an equivalent amount of anhydrous aluminum sulfate, aluminum fluoride, aluminum chloride, aluminum bromide, aluminum iodide, aluminum nitrate, aluminum bisulfate, sodium aluminum sulfate and potassium aluminum sulfate, respectively, and equivalent results are secured.

EXAMPLE II

The following is a stable liquid fabric softening composition having improved anti-static properties.

| Ingredient | Wt.% |
|---|---|
| Di-tallowalkyl dimethyl ammonium chloride | 5.25 |
| $Al_2(SO_4)_3.18\ H_2O$ | 1.0 |
| Coconutalkyl ethanol amide* | 3.0 |
| Emulsifier** | 0.5 |
| Optical brightener, perfume, colorant | Minor |
| Isopropyl alcohol | Minor (ca. 1.2% from processing) |
| Water | Balance |

* Available as P&G Amide No. 27

** 1:1 wt. mixture of tri- and nona-ethoxylates of secondary alcohol mixtures wherein the alcohol contains an average of 13 carbon atoms, marketed as Tergitol 15-S-3 and Tergitol 15-S-9.

The foregoing composition is prepared by admixing the hydrated aluminum sulfate and a fluidized mass comprising the di-tallowalkyl ammonium chloride and 5% (wt.) isopropyl alcohol-water to disperse the aluminum sulfate uniformly throughout the quaternary compound. The mixture is blended in a colloid mill and passed through a ribbon mixer into a solution comprising the amide, water and minor components. The resulting dispersion proves to be stable and does not separate on storage.

The foregoing composition is added to an aqueous rinse bath at a concentration of 0.03% by weight. Cotton, nylon, polyester and polyester blend fabrics are immersed in the rinse bath for about 2 minutes and removed. The fabrics so treated are softened and exhibit substantially less static charge than fabrics similarly treated with commercial fabric softeners containing di-tallowalkyl di-methyl ammonium chloride, but without the hydrated aluminum sulfate.

In the foregoing composition, the coconutalkyl ethanol amide is replaced by an equivalent amount of stearyl diethanol amide, N,N-dimethyl decanamide, isostearyl diethanol amide, and mixed tallowalkyl dimethyl amide, respectively, and equivalent results are secured.

In the foregoing composition, the di-tallowalkyl dimethyl ammonium chloride is replaced by an equivalent amount of di-stearyl dimethyl ammonium chloride, bis-(2-hydroxystearyl) diethyl phosphonium bromide, bis-(2-chlorostearyl) dibutyl phosphonium methylsulfate, bis-(3-ethoxystearyl) octyl ammonium acetate and bis-(2-propoxystearyl) ammonium phosphate respectively, and equivalent results are secured.

In the foregoing composition the $Al_2(SO_4)_3.18\ H_2O$ is replaced by an equivalent amount of $Al_2(SO_4)_3$, LiCl.1 $H_2O$, $MgCl_2.6\ H_2O$, $CaCl_2.6\ H_2O$, NaCl, KCl, LiBr, NaF, Na acetate, $Ti(SO_4)_2$, and $Ti(C_2H_5O)_4$, respectively, and equivalent results are secured.

EXAMPLE III

A dryer-added fabric softener composition is prepared by spraying the melt of di-tallowalkyl dimethyl dimethyl ammonium chloride and hydrated aluminum sulfate from Example I uniformly onto a cotton flannel substrate at a rate of 1.2 g. of melt/yd$^2$ of substrate.

A 10 in. × 10 in. coated flannel prepared in the foregoing manner is added to a load of wet clothing in a standard, heated home clothes dryer. The fabrics are tumbled dry, and are provided with a softening and improved anti-static finish.

As can be seen from the foregoing, the compositions herein can be adsorbed on a solid carrier, such as water-soluble silicate or water-insoluble silica, at a weight ratio of sorbent:sorbate of about 6:1 to about 1:6, to provide free-flowing granular compositions.

The compositions herein can also be sorbed on and in substrates, especially flexible substrates such as cloth and paper, at a weight ratio of coating:substrate of about 0.01:1 to about 0.5:1 to provide dryer-added softening and anti-static compositions.

The compositions herein are also useful as liquid softening and anti-static compositions when stabilized with an amide in the manner disclosed hereinabove.

What is claimed is:

1. A substantially water-insoluble, water-dispersible anti-static composition, consisting essentially of:

i. a quaternary compound of the formula

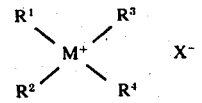

wherein M is nitrogen or phosphorus, X is any anion, $R^1$ is a hydrocarbyl moiety, $R^2$ is hydrogen or a hydrocarbyl moiety, the total carbon content of $R^1 + R^2$ being at least 22 carbon atoms, and $R^3$ and $R^4$ are each hydrogen or hydrocarbyl moieties; and ii. an electrically conductive salt selected from the group consisting of aluminum salts and non-fluosilicate lithium salts dispersed in said quaternary compound, at a weight ratio of quaternary compound: salt in the range of 1000:1 to 1:2.

2. A composition according to claim 1 wherein the quaternary compound is an ammonium compound.

3. A composition according to claim 2 wherein the ammonium compound is a di-long chain compound wherein $R^1$ and $R^2$ are each selected from the group consisting of 11–11–$C_{18}$ alkyl moieties, and mixtures thereof, and wherein $R^3$ and $R^4$ are each selected from the group consisting of $C_1$–$C_3$ alkyl moieties, and mixtures thereof.

4. A composition according to claim 3 wherein the ammonium compound is di-tallowalkyl dimethyl ammonium chloride.

5. A composition according to claim 1 wherein the bonding in the electrically conductive salt is of greater than 50 percent ionic character.

6. A composition according to claim 5 wherein the conductive salt is hydrated.

7. A composition according to claim 1 wherein the conductive salt is selected from the group consisting of $Al_2(SO_4)_3$, $Al_2(SO_4)_3.18\ H_2O$, and $LiCl.1\ H_2O$.

8. A composition according to claim 1 wherein the weight ratio of quaternary compound:conductive salt is in the range of about 20:1 to 1:2.

9. A composition according to claim 1, comprising:

i. from about 5 to about 50% by weight of $Al_2(SO_4)_3.18\ H_2o$; and H ii. from about 50to about 95% by weight of di-tallowalkyl dimethyl ammonium chloride.

10. A fabric softener composition having improved anti-static properties, consisting essentially of:

a. from about 1 to about 45% by weight of a substantially water-insoluble, water-dispersible softener and anti-static component, consisting essentially of:

i. a quaternary compound of the formula

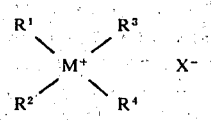

wherein M is nitrogen or phosphorus, X is any anion, $R^1$ is a hydrocarbyl moiety, $R^2$ is hydrogen or a hydrocarbyl moiety, the total carbon content of $R^1 + R^2$ being at least 22 carbon atoms, and $R^3$ and $R^4$ are each hydrogen or hydrocarbyl moieties; and ii. an electrically conductive salt selected from the group consisting of aluminum salts and lithium salts dispersed in said quaternary compound, at a weight ratio of quaternary compound:salt in the range of 1000:1 to 1:2, dispersed in;

b. from about 10 to about 95% by weight of a non-solubilizing liquid carrier component; and c. from about 0.1 to about 45% of an amide dispersion stabilizing component, the weight ratio of said amide to said quaternary compound being at least 0.1:1.

11. A composition according to claim 10 wherein the quaternary compound is a di-long chain ammonium compound wherein $R^1$ and $R^2$ are each selected from the group consisting of $C_{11}$–$C_{18}$ alkyl moieties, and mixtures thereof, and wherein $R^3$ and $R^4$ are each selected from the group consisting of $C_1$–$C_3$ alkyl moieties, and mixtures thereof.

12. A composition according to claim 10 wherein the quaternary compound is di-tallowalkyl dimethyl ammonium chloride.

13. A composition according to claim 10 wherein the liquid carrier is selected from the group consisting of water and water-alcohol mixtures having a water:alcohol weight ratio in the range of from 100:1 to 2:1.

14. A composition according to claim 10 wherein the amide dispersion stabilizing component is of the formula.

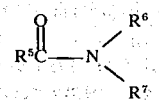

wherein $R^5$ is a $C_{10}$–$C_{20}$ hydrocarbyl moiety, or mixtures thereof, and $R^6$ and $R^7$ are each selected from hydrogen, hydroxyalkyl, alkoxy, or hydrocarbyl moieties, the total carbon content of $R^6 + R^7$ being less than 20 carbon atoms.

15. A composition according to claim 10, comprising:

a. from about 1 to about 15% by weight of a substantially water-insoluble, water-dispersible softener and anti-static component consisting essentially of:

i. from about 40 to about 99% by weight of di-tallowalkyl dimethyl ammonium chloride; and ii. from about 1 to about 60% by weight of a conductive salt selected from the group consisting of $Al_2(SO_4)_3$, $Al_2(SO_4)_3.18\ H_2O$, and $LiCl.1\ H_2O$;

b. from about 70 to about 99% by weight of a liquid carrier component selected from the group consisting of water and water-alcohol mixtures containing less than about 10% alcohol; and c. from about 0.2 to about 15% by weight of an amide stabilizing component selected from the group consisting of coconutalkyl ethanol amide and iso-stearyl diethanol amide.

16. A composition according to claim 15 wherein the conductive salt is $Al_2(SO_4)_3.18\ H_2O$ and the amide is coconutalkyl ethanol amide.

17. A composition according to claim 15 wherein the conductive salt is $Al_3(SO_4)_3.18H_2O$ and the amide is iso-stearyl diethanol amide.

18. A fabric softening and anti-static composition adapted for use in a clothes dryer, consisting essentially of:

a. a substrate component; and b. a fabric softening and anti-static component consisting essentially of:

i. a member selected from the group consisting of substantially water-insoluble quaternary ammonium and substantially water-insoluble quaternary phosphonium compounds; and ii. an electrically conductive salt selected from the group consisting of aluminum salts and lithium salts dispersed in said quaternary compound at a weight ratio of quaternary compound:salt in the range of from 1000:1 to 1:2;

said fabric softening and anti-static component being sorbed on and in said substrate component.

* * * * *

UNITED STATES PATENT OFFICE

CERTIFICATE OF CORRECTION

PATENT NO. : 3,958,059

DATED : May 18, 1976

INVENTOR(S) : Francis L. Diehl

It is certified that error appears in the above-identified patent and that said Letters Patent are hereby corrected as shown below.

Claim 3, column 11, line 1, "11-11-$C_{18}$" should read -- $C_{11}$-$C_{18}$ --.

Claim 17, column 12, line 44, "$Al_3(SO_4)_3 \cdot 18\ H_2O$" should read -- $Al_2(SO_4)_3 \cdot 18\ H_2O$ --.

Signed and Sealed this

Tenth Day of August 1976

[SEAL]

*Attest:*

RUTH C. MASON
*Attesting Officer*

C. MARSHALL DANN
*Commissioner of Patents and Trademarks*